US005168584A

United States Patent [19]

Peebles

[11] Patent Number: 5,168,584

[45] Date of Patent: Dec. 8, 1992

[54] RETRACTABLE PERIMETER BARRIER

[76] Inventor: Donald S. Peebles, 6103 95th St. Cir. E., Bradenton, Fla. 34202

[21] Appl. No.: 765,573

[22] Filed: Sep. 25, 1991

[51] Int. Cl.[5] ..... E04H 4/06; E04H 17/16

[52] U.S. Cl. ..... 4/504; 4/506; 256/25

[58] Field of Search ..... 4/488, 494, 496, 504, 4/506, 507, 509, 510; 256/24, 25, 73

[56] References Cited

U.S. PATENT DOCUMENTS

| | | | |
|---|---|---|---|
| 2,805,046 | 9/1957 | Petterson | 256/25 |
| 3,094,710 | 6/1963 | Hoke | 4/504 X |
| 3,227,422 | 1/1966 | Loeb | 4/494 X |
| 3,566,420 | 3/1971 | Peterson et al. | 4/494 |
| 3,648,300 | 3/1972 | Eisenberg | 4/504 X |
| 3,994,479 | 11/1976 | Johannesson | 4/504 X |
| 4,023,217 | 5/1977 | Kessler | 4/510 |
| 4,083,535 | 4/1978 | Britt | 256/73 X |
| 4,170,796 | 10/1979 | Schiron et al. | 4/510 X |
| 4,380,327 | 4/1983 | Fish | 256/73 X |
| 4,623,126 | 11/1986 | Pettit | 4/496 X |

FOREIGN PATENT DOCUMENTS 2310199 9/1974 Fed. Rep. of Germany ..... 4/494

*Primary Examiner*—William A. Cuchlinski, Jr.
*Assistant Examiner*—John L. Beres
*Attorney, Agent, or Firm*—Charles J. Prescott

[57] ABSTRACT

A retractable perimeter barrier for a swimming pool including a plurality of panels each vertically movably positioned in edge-to-edge orientation within a trough. The trough is generally U-sectioned open along its margin and buried in upright position within the ground or deck area adjacent a swimming pool. Each panel includes a lower buoyant section of sufficient buoyancy to uprightly support the portion of the panel which extends above the buoyant section above the ground or deck within the trough when the trough is filled with water. Each panel will automatically retract or lower into the trough when water is drained therefrom. Water is preferably drawn from and returned to the swimming pool to fill and drain the trough.

14 Claims, 2 Drawing Sheets

RETRACTABLE PERIMETER BARRIER

BACKGROUND OF THE INVENTION

This invention is generally related to fences and wall barriers, and more particularly to a retractable perimeter barrier for a swimming pool.

Safety from inadvertently falling or stumbling into a swimming pool, particularly at night, is of great concern to any swimming pool owner or operator. Although not required by law in all locations, some communities require that, in prescribed circumstances, a fence be constructed around the entire swimming pool so as to prevent children or adults from inadvertently falling into the pool. Lighting at night helps to illuminate the pool so that a passerby will become aware of its presence to help avoid such an occurrence.

A number of devices are known to applicant which are intended to prevent inadvertent access to a swimming pool. One such device is disclosed in U.S. Pat. No. 3,994,479 to Johannesson which is directed to a removable fence for an above ground swimming pool.

Another device known to applicant is shown in U.S. Pat. No. 4,170,796 to Schiron which teaches a rigid protective wall extending along and adjacent to the longitudinal walls of a wave bath-type swimming pool.

Fish, in U.S. Pat. No. 4,380,327, teaches a collapsible safety perimeter barrier for swimming pools. This invention includes a plurality of vertical support members which are easily removed by lifting them from the sleeves located in the pool deck and folding the fence into a storable position.

U.S. Pat. No. 4,623,126 also teaches a universal perimeter fence for an above ground swimming pool.

All of the above devices require their physical removal thereof in order to eliminate the presence of these barriers from around the pool while the pool is in use.

The present invention provides a retractable perimeter swimming pool barrier which is vertically actuated by the presence or absence of water within a support trough buried within the ground. When the trough is filled with water, the barrier upwardly extends into its normal inuse position. By draining or pumping the water from the trough, the barrier retracts into the trough into an unobtrusive, stored position, generally flush with the deck or ground surrounding the swimming pool.

BRIEF SUMMARY OF THE INVENTION

This invention is directed to a retractable perimeter barrier for a swimming pool including a plurality of panels each vertically movably positioned in edge-to-edge orientation within a trough. The trough is generally U-sectioned open along its margin and buried in upright position within the ground or deck area adjacent a swimming pool. Each panel includes a lower buoyant section of sufficient buoyancy to uprightly support the portion of the panel which extends above the buoyant section above the ground or deck within the trough when the trough is filled with water. Each panel will automatically retract or lower into the trough when water is drained therefrom. Water is preferably drawn from and returned to the swimming pool to fill and drain the trough.

It is therefore an object of this invention to provide a retractable swimming pool barrier which will automatically upwardly extend for use and which is easily retractable to a below ground position when not in use.

It is another object of this invention to utilize the buoyancy of each panel supported by water within the trough so as to control and regulate the upward in-use positioning and the lower retracted positioning of the barrier panels.

It is yet another object of this invention to utilize the swimming pool water to vertically actuate and position the swimming pool barrier.

In accordance with these and other objects which will become apparent hereinafter, the instant invention will now be described with reference to the accompanying drawings.

DETAILED DESCRIPTION OF THE INVENTION

Figure 1:
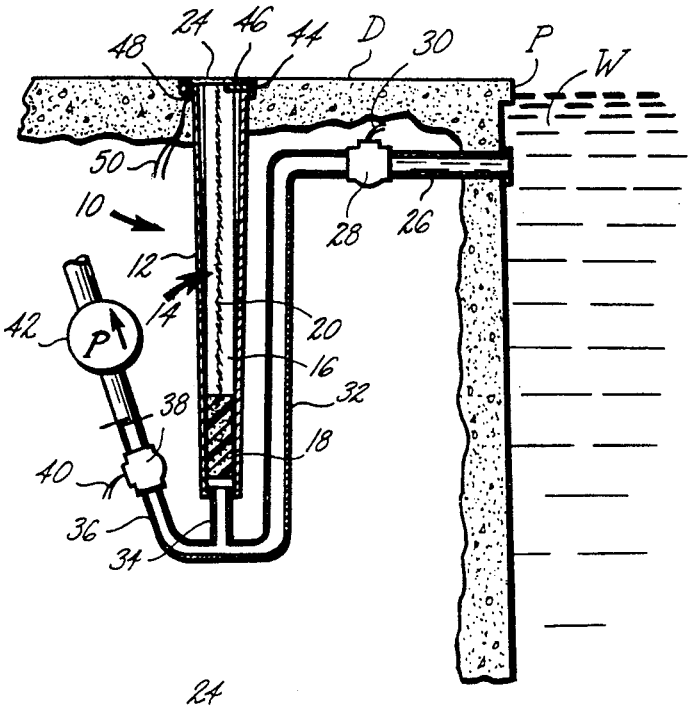
FIG. 1 is a vertical section view through one embodiment of the invention and the adjacent swimming pool deck and swimming pool showing the invention in its retracted, downward position.
Figure 2:
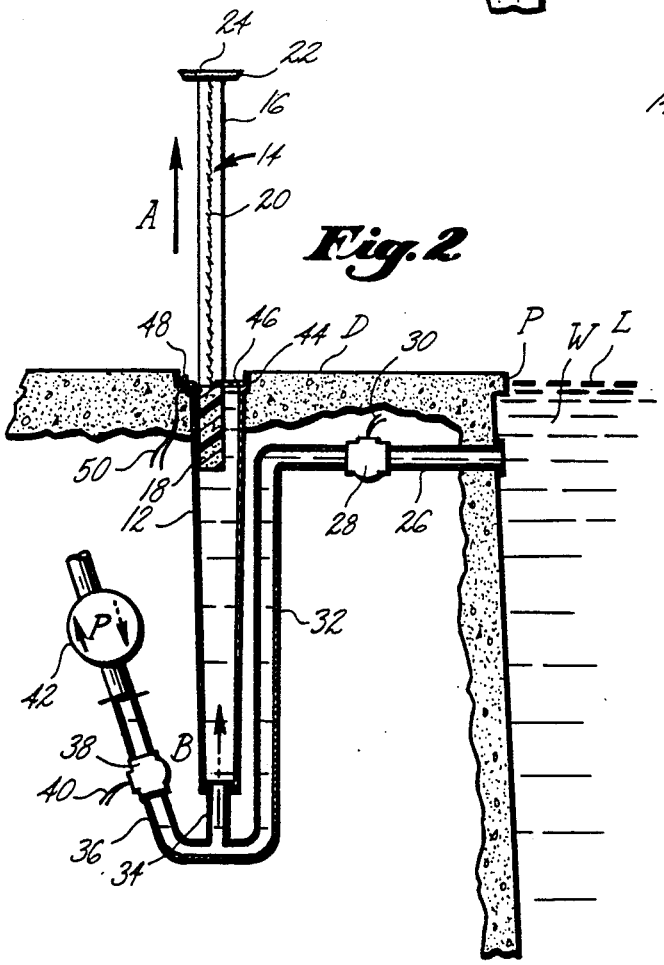
FIG. 2 is a view similar to FIG. 1 depicting the invention in its upward in-use position.
Figure 3:
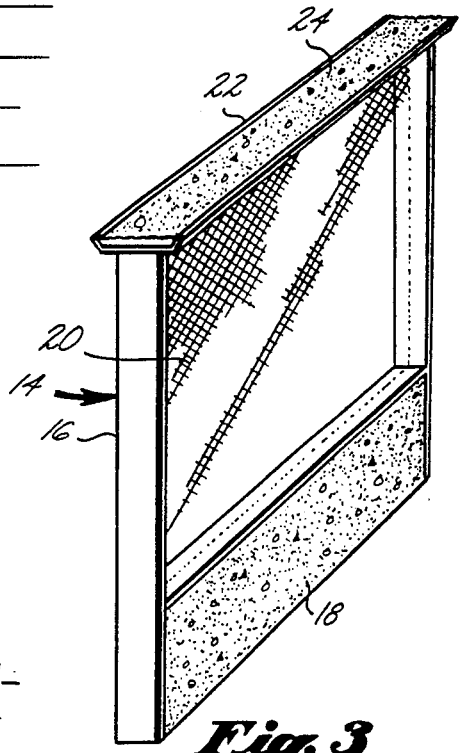
FIG. 3 is a perspective view of one movable buoyant panel of FIG. 1.

Referring now to the drawings, and particularly to FIGS. 1, 2 and 3, one embodiment of the invention is shown generally at numeral 10 and includes a general U-section thin-wall trough 12 which is fabricated of either thin sheet metal or, preferably plastic. This trough 12 is buried in upright orientation within the ground or deck D and fully surrounds the swimming pool P.

Freely vertically movable within trough 12 are a plurality of buoyant panels shown generally at numeral 14. These panels 14 are positioned within trough 12 generally extending therewithin in edge-to-edge orientation along the entire length of trough 12. As best seen in FIG. 3, these panels 14 include a rigid frame 16 having a buoyant lower section 18 fabricated preferably of closed cell foam such as STYROFOAM. A sheet of screen or mesh material 20 is disposed across the remainder of the central portion of panel 14 to minimize weight. A decorative top channel 22 is also provided which is preferably filled with decking material 24 which is similar in appearance to the surface of deck D. Top channel 22 nests within flanges 44 and 48 longitudinally formed into the upper margin of trough 12.

In FIG. 1, the panel 14 is shown in its downward retracted or stored position wherein decking material 24 is generally flush with the deck D and buoyant section 18 is in close proximity to the bottom of trough 12 which is empty of water. When inlet valve 28 is controlledly opened by suitably activating electrical wires 30 by a suitable control means, water W within swimming pool P enters into conduit 32 through conduit 26. Thereafter, the entire trough 12, bottom conduit 34 and drain conduit 36 are filled with swimming pool water W. Drain shut-off valve 38 has been closed by switching a suitable control element to energize wires 40 to close valve 38.

As best seen in FIG. 2, when inlet valve 28 is open and outlet valve 38 is closed, water W rises within trough 12 to the level L of the water within the swimming pool P. A stop 46 acts against the upper surface of buoyant section 18 so as to stop panels 14 from rising excessively to maintain the entire volume of buoyant section 18 within water W. The buoyancy factor of buoyant section 18 is such that the entire panel 14 will be maintained in an upward position in the direction of arrow A so long as the water level W is generally maintained at the level of swimming pool P within trough 12. One vertical surface of panel 14 along the side of buoyant section 18 contacts against the inner surface of trough 12 to provide external stability to panels 14.

To evacuate the water W from trough 12 so as to retract the panels 14, a pump 42 is provided which may be the swimming pool recirculating pump. When inlet valve 28 is closed and outlet valve 38 is opened, pump P, when activated, will draw water out in the direction of the solid arrow and preferably return that water W back into the swimming pool P.

A limit switch 48 operably connected by electrical wiring 50 is also provided connected at the upper margin of trough 12 which interacts with top plate 22 so as to stop the water evacuation action of water from trough 12 by interrupting electrical power to pump 42 when the trough is fully emptied and/or the panel 14 is fully retracted.

In practice, although the buoyant sections 18 of each panel 14 are chosen to be of more than sufficient buoyancy to lift each panel 14 as above described and shown in FIG. 2, nonetheless inorganic and organic build-up within trough 12 is likely, as well as some slight binding and cocking of the panels 14 as they are upwardly floated in the direction of arrow A in FIG. 2. To enhance this upward movement of each panel, pump 42 may be utilized to pump pool water W into trough 12 in the direction of the arrow shown in phantom. This will result in an upward jet of water in the direction of arrow B which will impinge upon the bottom surface of each panel 14 so as to upwardly urge the panels 14 as the trough 12 is being filled with water. The sequence of valve positioning will then be altered, i.e. outlet valve 38 will also be opened until the trough 12 is filled or until each panel 14 starts to move upward.

Figure 4:
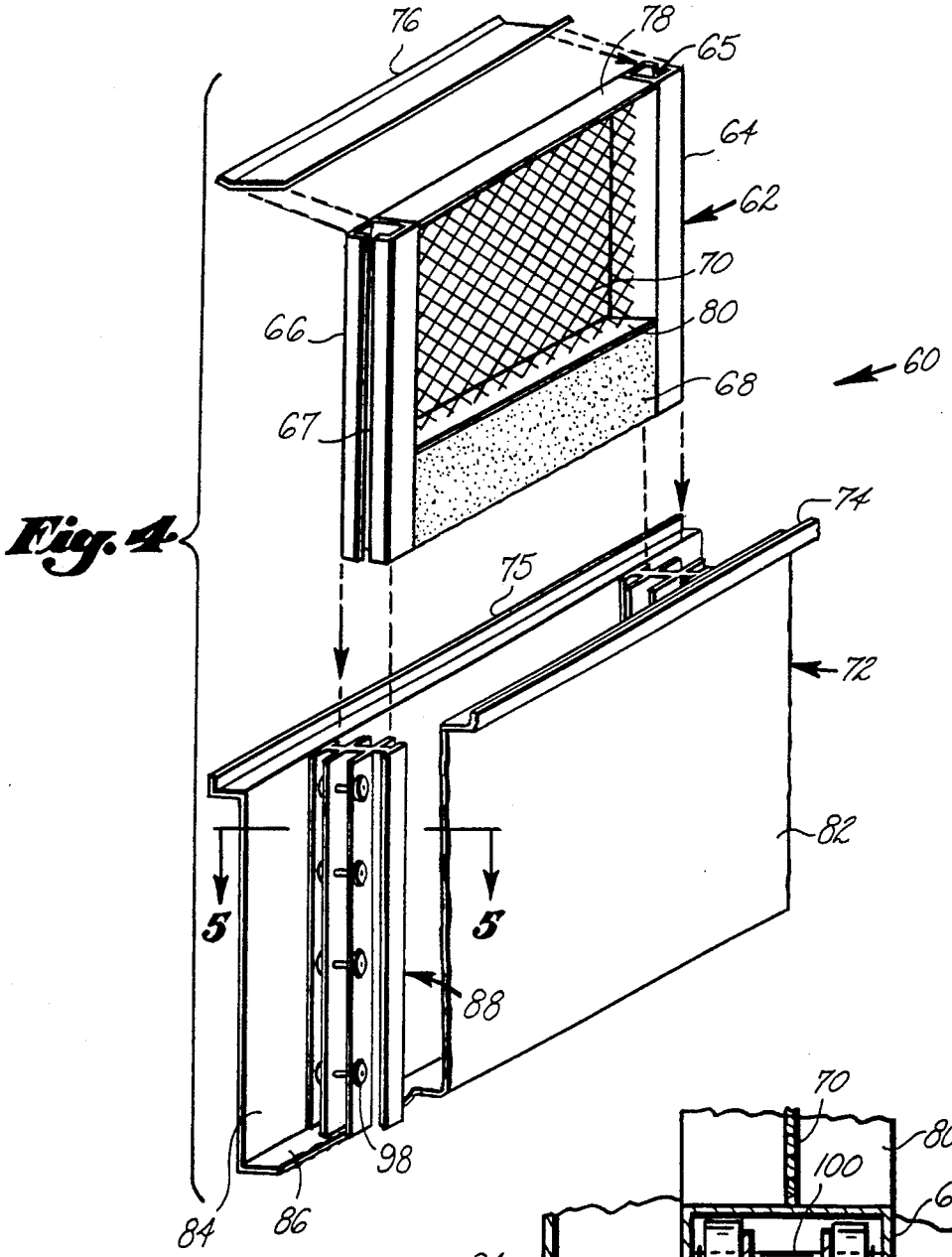
FIG. 4 is an exploded perspective view of another embodiment of the invention.
Figure 5:
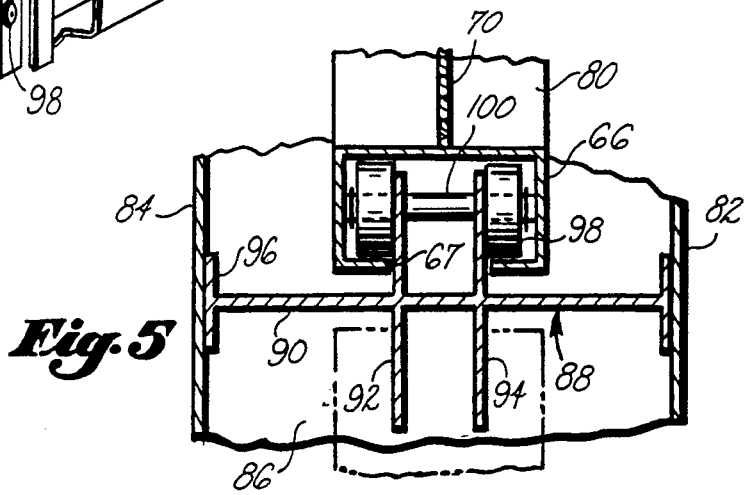
FIG. 5 is a section view in the direction of arrow 5–5 in FIG. 4.

Referring now to FIGS. 4 and 5, the preferred embodiment of the Invention is shown generally at numeral 60 and includes a trough assembly 72 and a plurality of panel assemblies shown generally at 62. Each panel 62 includes an upright C-shaped section channel 64 and 66 held spaced apart by upper and mid horizontal plates 78 and 80, respectively. A buoyancy section 68 is also provided held between a channels 64 and 66 and beneath plate 80. As before, the buoyancy section 68 is of sufficient buoyancy so as to support the entire panel assembly 62 within water in trough assembly 72 as previously described.

Connected atop upper plate 78 is a top plate 76 which is flanged upwardly along its longitudinal margins to receive deck material such as concrete or epoxy gravel of a texture similar to the decking into which the assembly will be installed.

The trough assembly 72 is generally fabricated having an elongated U-section open at its upper end having upright side panels 82 and 84 spaced apart by bottom panel 86 and outwardly extending at flanges 74 and 75 to receive enlarged top plate 76 when panel 62 is in its downward retracted position.

Also provided within trough assembly 72 are upright tracks or channels 88. These channels 88 are formed of an elongated extruded section having a transverse central web 90 and mounting flanges 96 at each end thereof which interconnect against the inner surfaces of side walls 82 and 84 as best seen in FIG. 5. Extending longitudinally in either direction from central web 90 are bearing support flanges 92 and 94 to which are mounted opposing pairs of roller bearings 98 on horizontal shafts 100 spaced along the length of flanges 92 and 94.

These channel assemblies 88 are connected vertically in spaced apart relationship in accordance with the length of each panel assembly 62 so that channels 64 and 66 rollably engage for vertical up and down movement over rollers 98 as shown in FIG. 5. Thus, each panel 62 is allowed to freely move only with up and down movement and is otherwise restrained from any significant movement in any other direction.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A retractable perimeter barrier for a swimming pool comprising a plurality of panels, each panel of said panel plurality having a lower buoyant section and an upper edge;

a generally U-section trough open at its upper end, said trough sized to freely slidably receive each said panel therein in edge-to-edge orientation of said panels, said trough buried in upright orientation in the ground or deck adjacent the swimming pool and to a depth wherein said upper end is generally flush with the ground or deck;

a water supply means operably connected to said trough for selectively filling said trough with, and emptying said trough of, water;

said buoyant section of each said panel having sufficient buoyancy to upwardly lift and maintain each said panel so as to position each upper edge above the ground or deck, each said elevated panel supported in elevated upright orientation by said trough to form said barrier when said trough is filled with water;

each said panel lowering into said trough as water is evacuated from said trough.

2. A retractable perimeter barrier for a swimming pool as set forth in claim 1, wherein:

said water supply means further includes an inlet conduit means positioned below the water level of the swimming pool for conveying swimming pool water by gravity into said trough and a drainage conduit means positioned near a lower end of said trough for draining water from said trough.

3. A retractable perimeter barrier for a swimming pool as set forth in claim 2, wherein:

said water supply means further includes a water pump connected to said drainage conduit means, said water pump operably connected between said drainage conduit means and the swimming pool whereby water draining from said trough is pumped back into the swimming pool by said water pump.

4. A retractable perimeter barrier for a swimming pool as set forth in claim 3, wherein said water supply means further includes:

an inlet shut-off valve connected in said inlet conduit means for controlling water flow from the swimming pool into the trough;

an outlet shut-off valve connected in said drainage conduit means between said trough and said water pump for controlling water flow from said trough into said water pump.

5. A retractable perimeter barrier for a swimming pool as set forth in claim 4, further comprising:

a stop plate connected to said trough adjacent each said panel structured to contact and prevent vertical travel of each said panel in a fully upwardly extended position wherein each said buoyancy section is submerged in the water in close proximity to the water level of the swimming pool and a fully lowered position of each said panel wherein each said upper edge is in close proximity to the surface of the ground or deck.

6. A retractable perimeter barrier for a swimming pool as set forth in claim 5, further comprising:

a shut-off switch connected to said trough adjacent one said panel in electrical communication with said outlet shut-off valve structured to close said outlet shut-off valve when said one panel is fully lowered into said trough.

7. A retractable perimeter barrier for a swimming pool as set forth in claim 6, wherein:

said water pump is reversible to pump swimming pool water into said trough through said drainage conduit means;

said water pump having sufficient pumping capacity to direct pool water into said trough and to impinge against a bottom surface of each said lower buoyant section to assist in lifting each said panel.

8. A retractable perimeter barrier for a swimming pool as set forth in claim 1, wherein said water supply means further includes:

an inlet shut-off valve connected in an inlet conduit for controlling water flow from the swimming pool into the trough;

an outlet shut-off valve connected in a drainage conduit means between said trough and a water pump for controlling water flow from said trough into said water pump.

9. A retractable perimeter barrier for a swimming pool as set forth in claim 8, further comprising:

a stop plate connected to said trough adjacent each said panel structured to contact and prevent vertical travel of each said panel in a fully upwardly extended position wherein each said buoyancy section is submerged in the water in close proximity to the water level of the swimming pool and a fully lowered position of each said panel wherein each said upper edge is in close proximity to the surface of the ground or deck.

10. A retractable perimeter barrier for a swimming pool as set forth in claim 9, further comprising:

a shut-off switch connected to said trough adjacent one said panel in electrical communication with said outlet shut-off valve structured to close said outlet shut-off valve when said one panel is fully lowered into said trough.

11. A retractable perimeter barrier for a swimming pool as set forth in claim 10, wherein:

said water pump is reversible to pump swimming pool water into said trough through said drainage conduit means;

said water pump having sufficient pumping capacity to direct pool water into said trough and to impinge against a bottom surface of each said lower buoyant section to assist in lifting each said panel.

12. A retractable perimeter barrier for a swimming pool as set forth in claim 1, further comprising:

a decorative top plate covering the top of each said upper edge;

each said top plate generally matching and flush with the adjacent deck when each said panel is in its fully lowered position.

13. A retractable perimeter barrier for a swimming pool as set forth in claim 1, wherein:

each said panel includes central screened portion for reduced weight.

14. A retractable perimeter barrier for a swimming pool as set forth in claim 1, further comprising:

upright track means connected in said trough for guiding each said panel up and down within said trough.

* * * * *